US005131541A

United States Patent [19]

Liebel

[11] Patent Number: 5,131,541

[45] Date of Patent: Jul. 21, 1992

[54] CORNER POST AND PACKAGING SYSTEM

[75] Inventor: Henry L. Liebel, Cincinnati, Ohio

[73] Assignee: Shippers Paper Products Company, Cincinnati, Ohio

[21] Appl. No.: 550,483

[22] Filed: Jul. 10, 1990

[51] Int. Cl.[5] ..... B65D 85/48

[52] U.S. Cl. ..... 206/453; 206/586; 229/DIG. 1

[58] Field of Search ..... 206/320, 326, 453, 586, 206/585; 229/DIG. 1

[56] References Cited

U.S. PATENT DOCUMENTS

| | | | |
|---|---|---|---|
| 2,324,031 | 7/1943 | Schiffenhaus | 206/453 |
| 2,348,483 | 5/1944 | Lacy et al. | 206/326 |
| 2,896,833 | 7/1959 | Markham | 206/453 |
| 3,335,932 | 8/1967 | Brown | 206/586 |
| 3,648,920 | 3/1972 | Stump | 206/586 |
| 3,653,496 | 4/1972 | Roberts et al. | 206/326 |
| 3,666,164 | 5/1972 | Nederveld | 206/320 |
| 3,684,636 | 8/1972 | Rothrock et al. | 206/586 |
| 4,027,817 | 6/1977 | Fremion | 206/320 |
| 4,212,394 | 7/1980 | Alley | 206/586 |
| 4,226,327 | 10/1980 | Ballard | 206/320 |
| 4,360,145 | 11/1982 | Wilcox | 206/586 |
| 4,399,915 | 8/1983 | Sorenson | 206/453 |
| 4,762,226 | 8/1988 | Gatton | 206/320 |
| 4,771,893 | 9/1988 | Liebel | 206/586 |
| 4,784,270 | 11/1988 | Layer et al. | 206/320 |
| 4,865,201 | 9/1989 | Liebel | 206/586 |

*Primary Examiner*—David T. Fidei
*Attorney, Agent, or Firm*—Wood, Herron & Evans

[57] ABSTRACT

A corner post including an elongated member of corrugated in a right angle and a sheet of solid fibreboard laminated to the outside surface of the angle. The solid fibreboard laminate has end flaps extending beyond the end of the corrugated which in packaging systems may be grasped for lifting of packaged articles and loads from the top or may be folded over on themselves forming an end section receivable in slots in the corner of a tray forming an integrated packaging system.

11 Claims, 5 Drawing Sheets

CORNER POST AND PACKAGING SYSTEM

BACKGROUND OF THE INVENTION

This invention relates to the field of packaging and, more particularly, to packaging systems incorporating means for protecting the edges and corners of packaged articles, for example, appliances, such as washers, dryers, refrigerators, and the like, and palletized loads of cartons, crates, packages, boxes, bags and like against damage during handling, shipping, and storage. More specifically, this invention contemplates a corner post and tray packaging system having improved strength for packaging and palletizing a wide variety of goods.

In industry today, it is common practice to load diverse products contained in cartons, crates, boxes, bags, and like packages on a pallet and to secure them together by such means as stretch wrap or shrink wrap plastic film or metal or plastic binding straps to secure the packages to the pallet making them easier to move, handle, store, and ship in bulk loads. Consolidation of a multiple of small packages minimizes piece-by-piece handling at terminals, transfer points, warehouses, and the like. Larger articles of manufacture such as appliances are typically also secured to a pallet or slip sheet or are packaged with a special cap to permit movement by trucks. It is further a common practice in industry to employ corner posts at the corner and edges of the packaged load to protect the edges and corners of the packaged article from damage due to contact with other objects or due to impact during moving, handling, or storing. Further, the loads are frequently vertically stacked during shipment or storage to more efficiently utilize space. This stacking which may be three loads high imposes considerable weight on the bottom packages which without the presence of corner posts supporting the weight would tend to crush or collapse the bottom packages. However, the use of corner posts having relatively good compression or stacking strength permits stacking of the loads without crushing those at the bottom of the vertical stack. Thus, a wide variety of appliances such as refrigerators, freezers, air conditioners, and the like are shipped using corner posts to prevent damage to the appliance and to permit stacking of the appliances in a vertical stack to more fully utilize shipping and storage space.

It is also common practice in industry today to wrap a pallet load, article, or package with a plastic film, for example, a stretch wrap film which is tensioned and wrapped around the load, article, or package in the stretched condition after which when the tension is released the film relaxes and shrinks securing the pallet load together. Plastic or metal binding straps may also be used in addition to stretch wrap film to secure a top cap or bottom tray or to secure the load to a pallet, slip sheet or runners to permit lifting of the load with a lift truck. Palletized loads and packaged articles, including top caps, bottom trays, corner posts, and edge protectors enveloped in stretch wrap film are known to the industry.

Corner posts provide the packages with a number of benefits including the following. Strapping and stretch films can be applied tighter without fear of strap indentation or film crushing carton corners. Edges and corners are protected against hard knocks and strap and wrap indentation. Stacking strength is improved to better utilize storage space or space in trailers, rail cars, and containers. Less stretch wrap or fewer straps are required lowering cost. Package alignment and stacking is improved or made easier. Flow of strapping and film around corners is improved.

A wide variety of corner posts and edge protectors are known to the art. For example, Alley U.S. Pat. No. 4,212,394 shows a die cut and scored blank fabricated from corrugated paperboard or other type of stock material which can be erected to cushion edges and corners of a package. My U.S. Pat. Nos. 4,771,893 and 4,865,201 show other corner post constructions.

SUMMARY OF THE INVENTION

In accordance with the principles of this invention, an improved corner post having improved strength is provided. This corner post may take a number of configurations. Further, the present invention includes a packaging system comprising the interrelation of the improved corner post with a bottom tray and, optionally, a top tray or top cap as well to provide an integrated packaging system. In a presently preferred embodiment, the corner post of the present invention includes a piece of elongated corrugated board in the form of a right angle having an inside face interiorly of said right angle and an outside face exteriorly of said angle. A sheet of solid fibreboard, for example, laminated kraft linerboard of two or more plys, is laminated to the outside face of the corrugated board. The solid fiber laminate includes at at least one end a pair of flaps extending beyond the end of the corrugated board. These flaps are adapted to be folded into overlapping relation generally perpendicular to the faces of the right angle of the corrugated board to form an overlapped end section of the corner post. This overlapped end section is further adapted to be received into slots at the corner of a fibreboard tray to form an interlock between the corner post and the slotted tray. Four corner posts thus mount to the four corners of the tray. The slotted bottom tray may also include flaps integrally hinged to the side edges of the tray which flaps may be bent upwardly at right angles to the plane of the tray against the corner posts to form the bottom tray in an integrated packaging system.

At the other end of the corner post, the solid fibreboard laminate may likewise include a pair of flaps extending beyond the opposite end of the corner post. These flaps may be folded outwardly and interlocked with a basiloid top which is then banded or strapped permitting the palletized load or article to be lifted from the top by trucks for movement. The entire assembly may be wrapped with stretch film or other packaging film.

The corner post may take a number of forms. Preferably, the elongated corrugated board is double wall corrugated. On the interior face of the corrugated, a right angle formed of either single wall or double wall corrugated may be laminated to provide additional strength to the corner posts. Still further, a rigid preformed right angle formed of a number of plys of paper which have been laminated together and formed into a rigid angle may be laminated to the inner face of the double wall corrugated for additional strength and rigidity and to increase the thickness of the corner post for additional protection from damage due to impact with other articles and for protection from the strapping cutting into the corners or the stretch film crushing the corners.

DETAILED DESCRIPTION OF THE INVENTION

Figure 1:
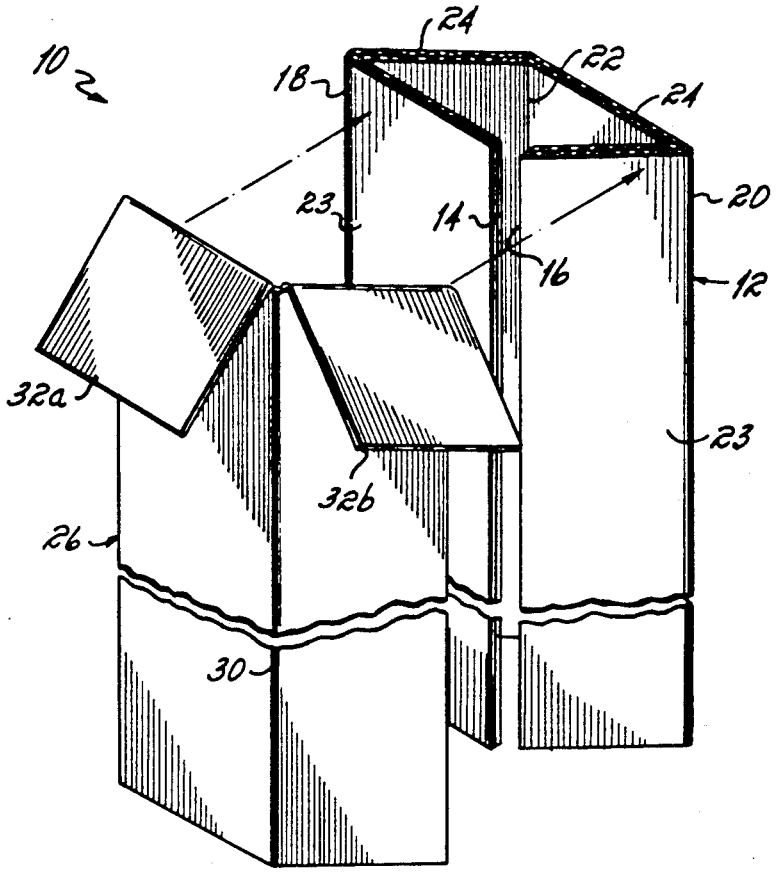
FIG. 1 is an exploded perspective view illustrating the corner post construction in accordance with this invention.

Referring now to FIG. 1, a corner post 10 in accordance with a presently preferred form of the invention includes an elongated member 12 of double wall corrugated board. The length of the corrugated board 12 is chosen to conform to the vertical height of the article or load to be packaged. The corrugated board 12 is folded upon itself and thus includes a pair of free edges 14, 16 extending along the length of the board, a pair of rounded edges 18, 20, and a bend line 22 intermediate the rounded edges 18, 20 and opposite of free edges 14, 16. The corrugated member 12 thus includes an exterior face 23 and an interior face 24. A suitable thickness of double wall corrugated board is in the range of 3/16 inch to ⅜ inch (before folding upon itself).

Figure 2:
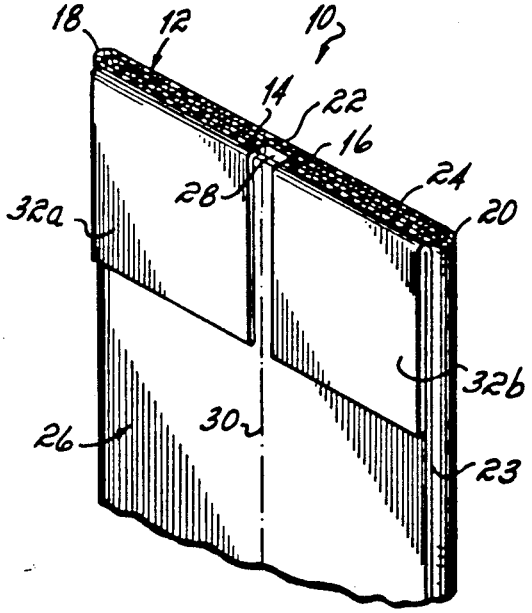
FIG. 2 is a perspective view of an end of the corner post illustrating its method of construction.

A sheet of solid fibreboard 26 is laminated to the outside face 23 of the corrugated board 12 as shown in FIG. 2. The solid fibreboard in a presently preferred form of the invention is laminated kraft 69 pound linerboard of two or more plys. Each ply of 69 pound linerboard has a thickness on the order 0.018". Thus, a two-ply linerboard would be on the order of 0.036" thick. The solid fibreboard reinforces the corner post, stiffens it, and provides it with increased strength particularly in the vertical direction.

Figure 3:
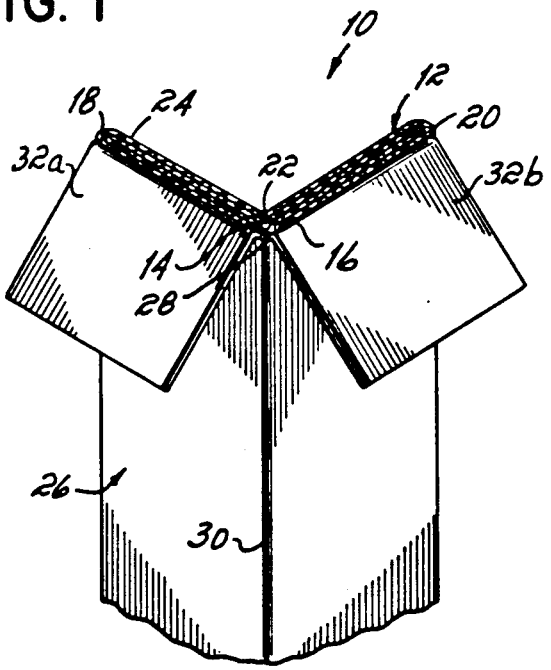
FIG. 3 is a view similar to FIG. 2 showing the completed construction of the corner post.

The free ends 14, 16 of the corrugated board 12 are spaced from each other, as shown at 28 in FIG. 2, such that the corrugated may be bent into a right angle as shown in FIG. 3. The fibreboard likewise has a bend line 30 permitting it to bend to a right angle with the corrugated board 12. In bending, the portion of the corrugated lying along bend line 22 may be actually captured in space 28 between the edges 14, 16, as shown in FIG. 3, forming a rigid right angle corner post.

At one or both ends of the corner post 10, the solid fiber laminate 26 includes additional lengths of material forming end flaps **32*a*, 32*b* which may be bent either inwardly or outwardly with respect to the right angle of the corner post 10. When bent inwardly, the flaps 32*a*, 32*b* overlap forming an overlapped end section at the end of the post which will be described in more detail hereinafter with reference to FIGS. 9–12. When bent outwardly as shown in FIG. 3, the flaps 32*a*, 32*b* may be bent 180° into generally overlying relation to the outside surface of the solid fibreboard laminate 26**.

Figure 4:
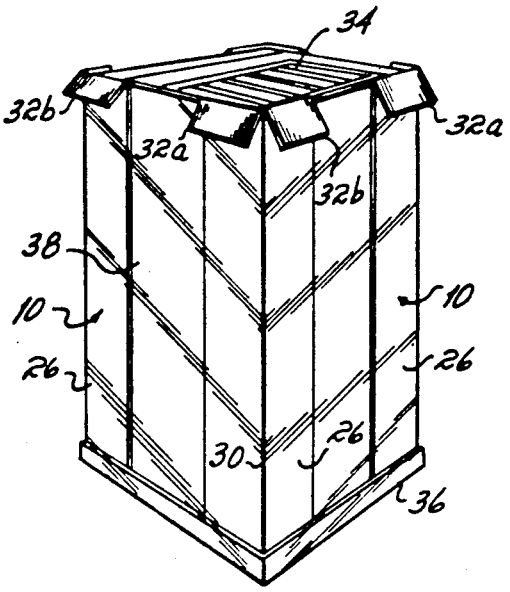
FIGS. 4–6 and 8 are perspective views illustrating one packaging application employing the corner post construction of the present invention.
Figure 5:
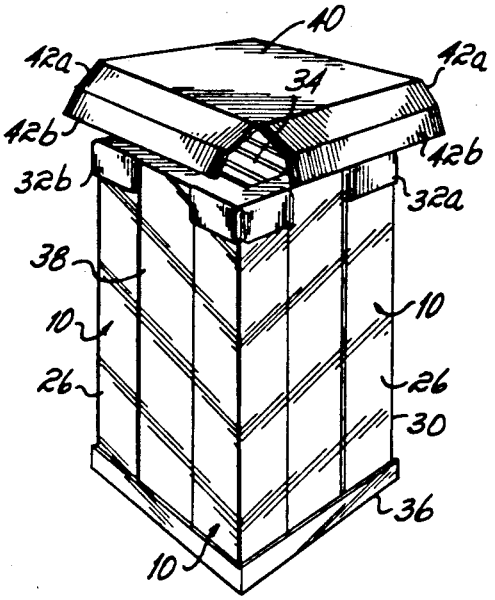
Figure 7:
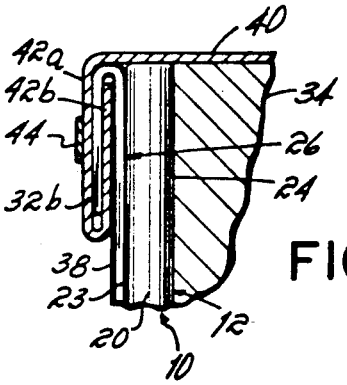
FIG. 7 is a cross-sectional view taken along line 7—7 of FIG. 6.
Figure 6:
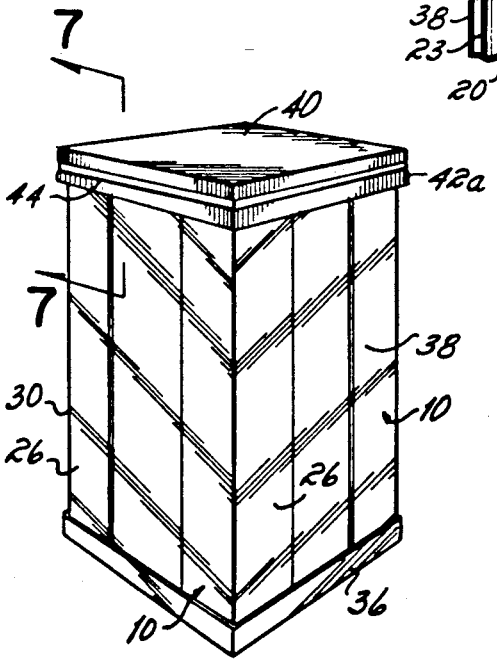

Referring now to FIGS. 4–8, in one packaging application, known as a basiloid top package, an article 34 to be packaged is placed in a bottom tray 36, which may be formed of corrugated, and has corner posts 10 at each of its four corners extending the height of the article 34. The package is wrapped in film, e.g., stretch wrap plastic 38 with the end flaps **32*a*, 32*b* extending outside of the film 38 (FIG. 4). A top cap 40 (FIG. 5) has a pair of contiguous hinged edge flaps 42*a*, 42*b*, which are hinged to the cap 40 along its four sides. The edge flaps 42*a*, 42*b* are adapted to be folded inwardly to interlock with the end flaps 32*a*, 32*b* and then be strapped by strap 44 to form the completed package (FIG. 6). That is, as described above, the solid fibreboard 26 laminated to the outside surface 23 of the corrugated corner post 10 includes the pair of end flaps 32*a*, 32*b*. The end flaps 32*a*, 32*b* are folded downwardly around the outside surface of the corner post 10 outside of the film 38. The top cap 40 is then placed on the package and the edge flaps 42*a*, 42*b* of the top cap 40 are bent downwardly and then inwardly into interlocking relationship with the end flaps 32*a*, 32*b* of the corner post 10, as shown in FIG. 7. This packaging construction thereby includes the interior corrugated 12 with laminated solid fibreboard 26 providing edge protection to the article 34, the one interior edge flap 42*a* of the top cap 40, the end flaps 32*a*, 32*b* of the fibreboard laminate 26, and the other edge flap 42*b* of the top cap 40 which are interlocked to the corner post 10. Thus, the entire package may be lifted from the top by a basiloid lifting device which grasps the package under the interlocked end and edge flaps 32, 42. It may be seen then that when such lifting is accomplished, the lifting force is carried by the solid fiber laminate 26 in a vertical direction and distributed along the length of the corner post 10 by virtue of the fibreboard being laminated to the corrugated corner post 10. The solid fiber member 26** has relatively good strength in its long direction permitting such lifting to be accomplished.

Figure 8:
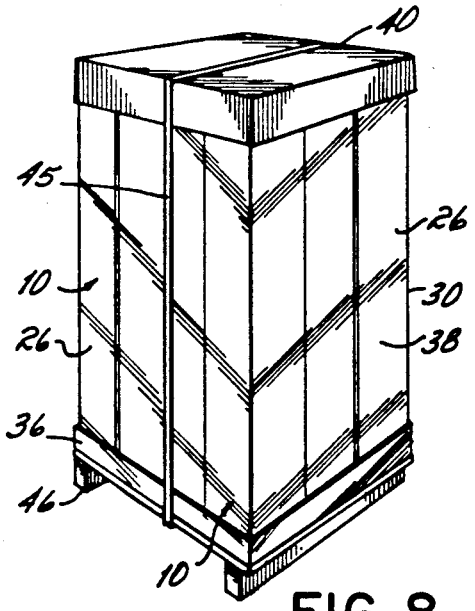

As shown In FIGS. 4–6, the load may be enveloped in a stretch wrap plastic film extending up to the top of the corner post 10 but permitting the end flaps **32*a*, 32*b* to be folded outwardly and downwardly into their interlocking relationship with the top cap 40. As shown in FIG. 8, any variety of metal or plastic strapping or bands 45 may be used to secure the load as desired including, for example, securing the load to a pallet 46**.

The corner post construction shown in FIGS. 1–3 has by virtue of its outer laminate of solid fibreboard 26 good strength permitting application of forces particularly in the vertical direction on the solid fibreboard which otherwise could not be maintained by a corrugated corner post alone.

In accordance with a further embodiment of the invention, there is shown with reference to FIGS. 9–12, a packaging system including an interlocking arrangement between the corner posts and a bottom tray and also optionally with either a top tray or a top cap. That is, although the interlocking packaging system shown in FIGS. 9–12 is shown with respect to both an interlocked bottom and top tray, it will be appreciated that the system could include an interlocking corner post and bottom tray arrangement with the top cap shown in the earlier FIGS. 4–8.

Figure 9:
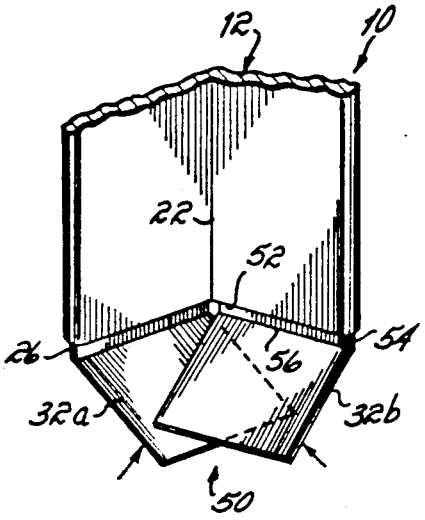
FIGS. 9–12 are perspective views showing the interlocking tray and corner post embodiment of the present invention.
Figure 10:
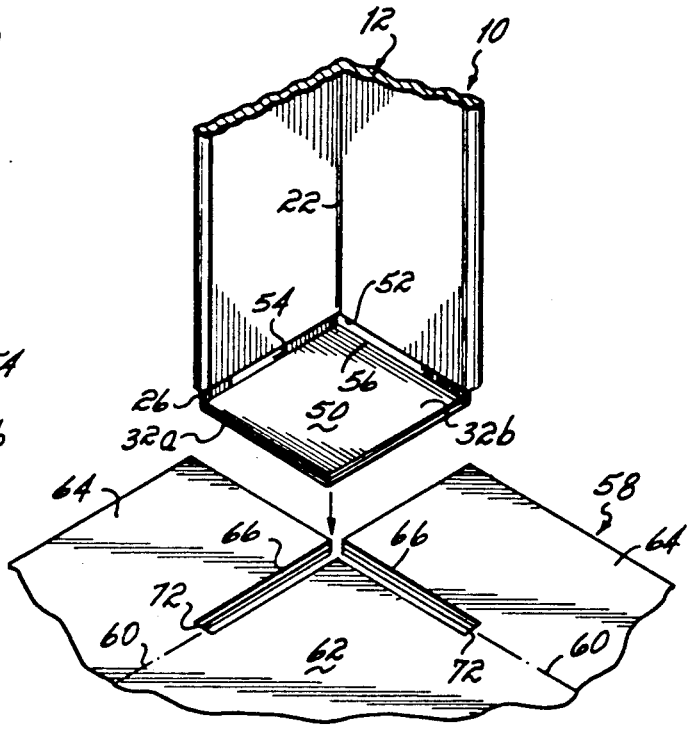
Figure 11:
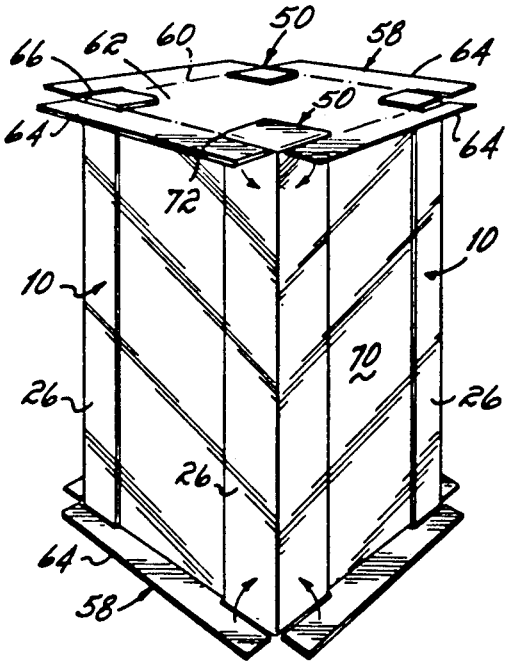
Figure 12:
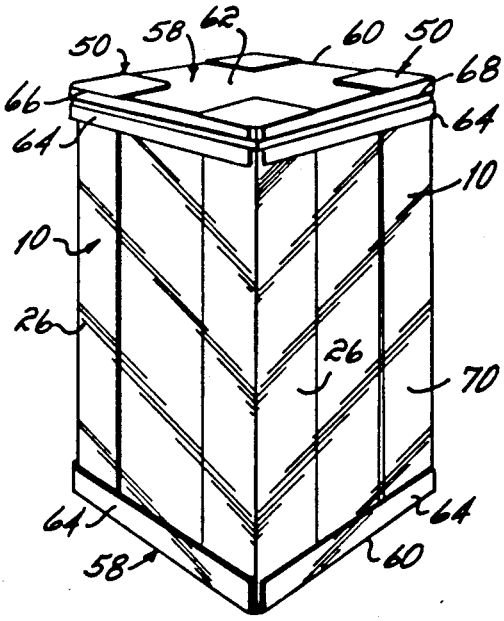

In the embodiment shown in FIGS. 9–12, at the ends of the corner post 10, the end flaps **32*a*, 32*b* of the solid fibreboard laminate 26 are brought together in overlapping relationship and laminated together to form an overlapped end section 50 of generally square configuration. (The planar faces of ends flaps 32***a*, 32*b* are generally perpendicular to the surfaces 23, 24 of the corner post 10.) The end flaps 32*a*, 32*b* extend beyond the one end 52 of the corrugated 12 providing a space 54 between the end 52 of the corrugated 12 and the fold or bend line 56 of the end flaps 32*a*, 32*b* (FIG. 9). The space 54 is generally equal to the thickness of a tray 58 (FIG. 10), either a top tray or a bottom tray, which is to be interlocked with the corner post 10. Referring to FIG. 10, tray 58, which may be formed of a suitable material such as double wall corrugated, has a generally square or rectangular configuration conforming to the configuration of the article or load of packages with which it is intended to be used. The tray 58 is scored or crushed along four side edges 60 defining a planar base portion 62 and edge flaps 64 hinged thereto along the side edges 60. Tray 58 is cut at its four corners along edges 60, for example, by die cutting to provide slots 66 for receiving the overlapped end section 50 of the corner post 10. That is, the overlapped end section 50 is fitted into the slots 66 with the overlapped end section 50 lying on one side of the planar section 62, the tray 58 and the tray corner fitting into the space 54 between the end 52 of the corrugated 12 and the overlapped end flaps 32*a*, 32*b* of the solid fiber laminate to form an interlocked corner post and tray construction (FIG. 11). The edge flaps 64 of the tray 58 may then be bent 90° to the planar section 62 of the tray 58 and secured in that position by a band 68 or stretch wrap 70, for example, to form a integral corner post and tray construction (FIG. 12).

It is generally preferred that the right angle legs of the corner post formed of the corrugated 12 extend beyond the vertical side edges of the solid fibreboard laminate 26 and beyond the ends 72 (FIG. 10) of the slots 66 in the tray 58 whereby the end 52 of the corrugated 12 bears against the planar face 62 of the tray 58 for an extended length along the side edges 60 to provide additional support for the corner post. As stated above, the present invention contemplates the interlocked corner post 10 and tray 58 construction at either the top or bottom of the package or both or, alternatively, the use of the interlocked tray shown in FIGS. 10 and 11 at the bottom and the top cap 40 shown in FIGS. 4–8 at the top.

Figure 13:
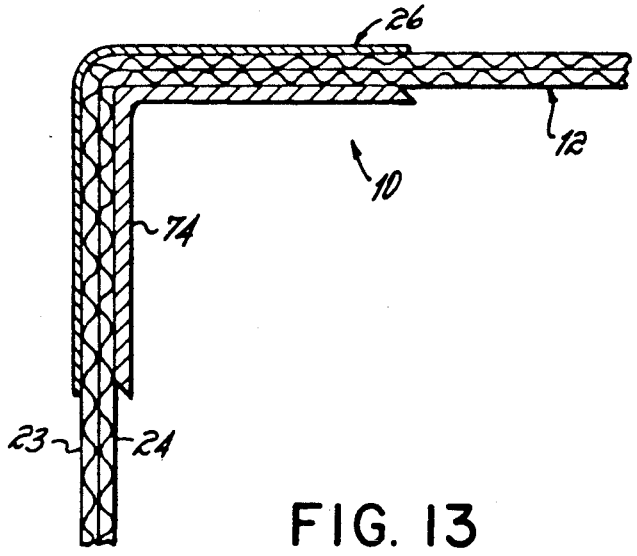
FIGS. 13–16 are cross-sectional end views showing alternative constructions of the corner post of the present invention.

Referring now to FIGS. 13–16, alternative embodiments of the corner post 10 construction of the present invention are shown. With reference to FIG. 13, the corner post 10 may optionally be formed of double wall corrugated 12 but not overlapped on itself. It may optionally include in addition to the double wall corrugated 12 and solid fibreboard 26 laminated to the outside surface 23 of the angle, a rigid solid fiber angle 74 laminated to the inside surface 24 of the double wall corrugated. The angle 74 may be formed of a number of plys of paper which are laminated together and formed into a right angle before the laminating medium has an opportunity to set completely thus forming a preformed right angle. Such an angle is highly rigid and has excellent strength in both the longitudinal and transverse directions. Its use in combination with the corrugated 12 keeps the corner post 10 from bowing and is particularly useful with non-appliance applications such as slack-filled loads wherein the corner post must confine the load and prevent outward bulging. The solid fiber angle 74 may conveniently be in a thickness of ⅛ inch to ⅜ inch.

Figure 14:
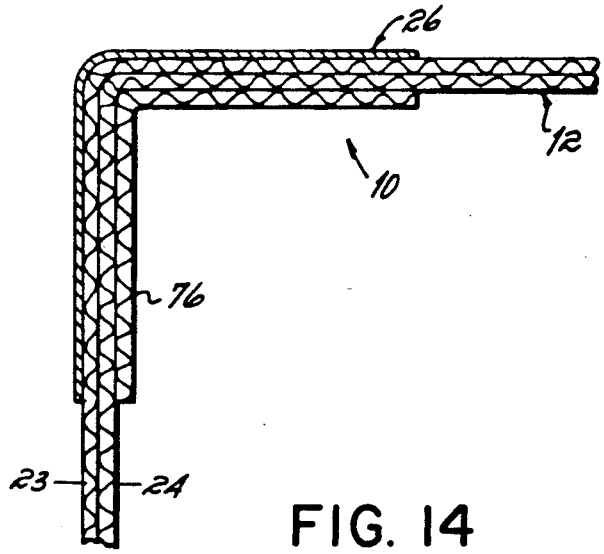

Referring now to FIG. 14, the corner post 10 also may be provided with more layers of right angle corrugated 76 laminated to the interior surface 24 of the corrugated 12 to give the corner post increased thickness and therefore increased cushioning and protection to the corners of the load, for example, to prevent denting on impact by other objects or cutting into the edge by the packaging bands.

Still further, the corner post 10 could be formed of single wall corrugated rather than double wall as the application may dictate. One alternative would include the use of single wall corrugated 12 with an additional angle formed of single wall or double wall corrugated 76 laminated to the inside surface of the angle in accordance with the embodiment shown in FIG. 14. Of course, as many layers may be used to reach a desired thickness. The solid fiber 26 laminated to the outside surface of the angle could alternatively be replaced with E-flute corrugated which has approximate thickness (not including the thickness of the facing sheets) of about 3/64" and includes 90±4 flutes per linear foot. E-flute corrugated is relatively thin providing a low profile corner post.

Figure 15:
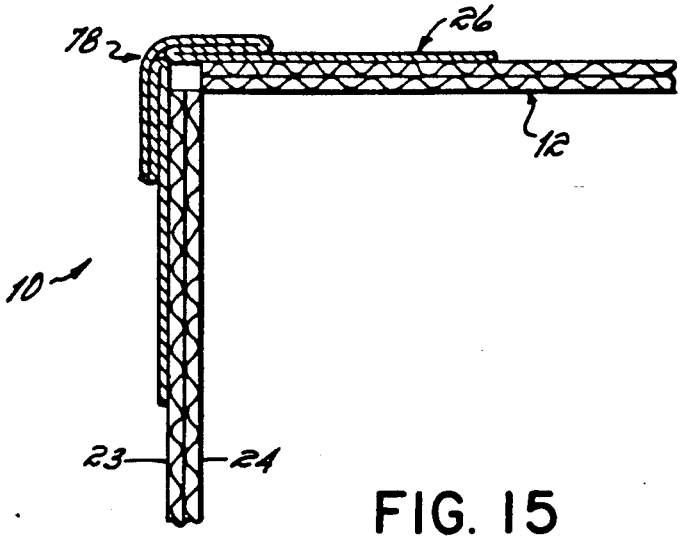

Referring to FIG. 15, the fibreboard laminate 26 could also be Z-folded upon itself at the right angle as shown at 78 to provide increased thickness of solid fiber to prevent, e.g., strap indentation at the corners.

Figure 16:
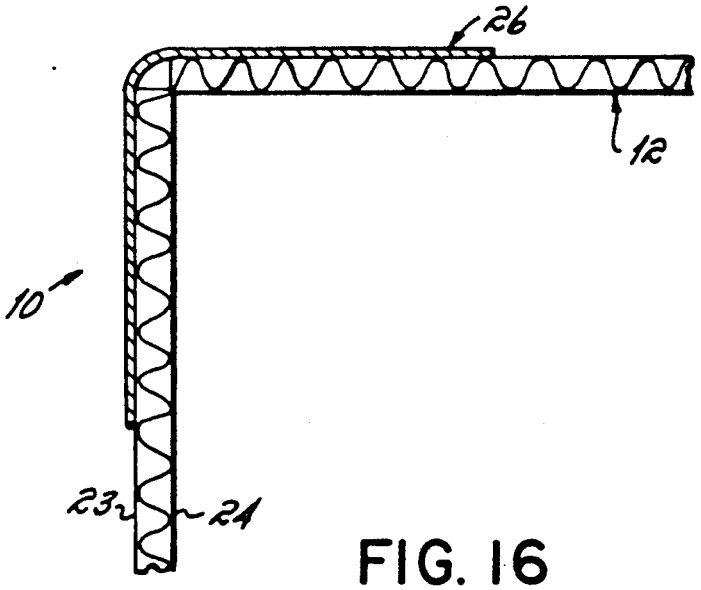

FIG. 16 shows the simplest embodiment of the corner post of the present invention. That is, this embodiment is useful in applications where stacking strength of the corner post is not a requirement, such as when stacking a load of articles such as cans which are both stackable and in themselves of sufficient strength to support the weight of the rows above so that the stacking strength of the corner post is not needed. However, a corner post may still be used to advantage as a fixture in which to stack the material, to provide rounded edges for wrapping of the stretch wrap plastic film about the load, and to provide an interlock with a basiloid top for lifting of the load from the top. In the embodiment shown in FIG. 16, a piece of single wall corrugated 12 is slit scored and bent to form a right angle. The sheet of solid fibreboard 26 is laminated to the corrugated in accordance with the description above. Although shown in cross-section, the ends of the solid fibreboard extend beyond the end of the corrugated providing the flaps 32*a*, 32*b* for interlocking with the top cap bottom tray as described above.

Thus having described the invention, what is claimed is:

1. A packaging assembly, comprising at least one corner post for cushioning and protecting an edge of an article or load, said corner post comprising:

at least one piece of elongated corrugated board in the form of a right angle having an inside face interiorly of said right angle and an outside face exteriorly of said angle, said corrugated board having a pair of opposed ends, a sheet of solid fibreboard laminated to said outside face of said corrugated board in the form of a right angle, said sheet of solid fibreboard at at least one end having a pair of flaps extending beyond one of said ends of said corrugated board and being adapted to be folded in overlapping relation generally perpendicular to said faces of said corrugated board to form an overlapped end section of said corner post, at least one tray having a first edge and a second edge meeting generally at right angles to define a corner, first and second flaps hinged to said first and said second edges, said corner being slotted along a portion of said first and second edges to receive in interlocking relation said overlapping end section of said corner post, said overlapping end section of said corner post being spaced from said one of said ends of said corrugated board a distance equalling generally the thickness of said tray such that said corner is captured between said overlapping end section and said one of said ends of said corrugated board, said first and second flaps of said tray being bendable to a generally perpendicular position against said corner post.

2. The packaging assembly of claim 1 wherein said elongated corrugated board includes a pair of long edges along the outboard edges of the right angle, and said solid fibreboard includes a pair of long edges spaced inwardly from said long edges of said corrugated board such that when said corner post is received in interlocking relation with said tray, said long edges of said corrugated board extend past the ends of the corner slots and said one of said ends of said corrugated board bears against said first edge and second edge of said tray over a portion of said ends.

3. The packaging assembly of claim 1 wherein said corrugated board is double wall corrugated.

4. The packaging assembly of claim 1 wherein said corner post further comprises a right angle member formed of multiple layers of paperboard laminated together and formed into a preformed rigid right angle, said member being laminated to the inside face of said one piece of elongated corrugated board.

5. The packaging assembly of claim 1 wherein said corner post further comprises a second piece of elongated corrugated board in the form of a right angle laminated to the inside face of said one piece of elongated corrugated board.

6. The packaging assembly of claim 1 wherein said solid fibreboard is Z-folded at the apex of the elongated corrugated board to increase the thickness of the solid fibreboard at said apex of said right angle.

7. The packaging assembly of claim 1 wherein said pair of flaps are adhered together to form said overlapped end section of said corner post.

8. A packaging assembly, comprising at least one corner post for cushioning and protecting an edge of an article or load, said corner post comprising:

at least one piece of elongated corrugated board in the form of a right angle having an inside face interiorly of said right angle and an outside face exteriorly of said angle, said corrugated board having a pair of opposed ends, a sheet of E-flute corrugated laminated to said outside face of said corrugated board in the form of a right angle, said sheet of E-flute corrugated at at least one end having a pair of flaps extending beyond one of said ends of said corrugated board and being adapted to be folded in overlapping relation generally perpendicular to said faces of said corrugated board to form an overlapped end section of said corner post, at least one tray having a first edge and a second edge meeting generally at right angles to define a corner, first and second flaps hinged to said first and said second edges, said corner being slotted along a portion of said first and second edges to receive in interlocking relation said overlapping end section of said corner post, said overlapping end section of said corner post being spaced from said one of said ends of said corrugated board a distance equalling generally the thickness of said tray such that said corner is captured between said overlapping end section and said one of said ends of said corrugated board, said first and second flaps of said tray being bendable to a generally perpendicular position against said corner post.

9. A packaging assembly, comprising four corner posts for cushioning and protecting the edges of an article or load, said corner posts comprising:

a piece of elongated corrugated board in the form of a right angle having an inside face interiorly of said right angle and an outside face exteriorly of said angle, said corrugated board having a pair of opposed ends, a sheet of solid fibreboard laminated to said outside face of said corrugated board, said sheet of solid fibreboard at at least one end having a pair of flaps extending beyond one of said ends of said corrugated board and being adapted to be folded in overlapping relation generally perpendicular to said faces of said corrugated board to form an overlapped end section of said corner post, at least one tray having a pair of first edges and a pair of second edges meeting generally at right angles to define the four corners of said tray, a pair of first and second flaps hinged to said pair of first and second edges, respectively, said four corners being slotted along a portion of said pair of first and second edges to receive in interlocking relation said overlapping end sections of said four corner posts, said overlapping end sections of said corner post being spaced from said one end of said ends of said corrugated board a distance equalling generally the thickness of said tray such that said corners are captured between said overlapping end sections and said one of said ends of said corrugated board, said pair of first and second flaps being bendable to a generally perpendicular position against said corner posts, and a sheet of stretch wrap plastic wrapped about and enveloping said article or load and said four corner posts.

10. A corner post for a packaging assembly comprising:

at least one piece of elongated corrugated board in the form of a right angle having an inside face interiorly of said right angle and an outside face exteriorly of said angle, said corrugated board having a pair of opposed ends, and a sheet of solid fiberboard laminated to said outside face of said corrugated board in the form of a right angle, said sheet of solid fiberboard at least one end having a pair of flaps extending beyond one of said ends of said corrugated board, said sheet of solid fiberboard being folded over upon itself along the apex of the right angle corrugated board to provide an increased thickness of said solid fiberboard along said outside face of said right angle.

11. A packaging assembly, comprising:

four corner posts for cushioning and protecting an edge of an article or load, each said corner post comprising:

at least one piece of elongated corrugated board in the form of a right angle having an inside face interiorly of said right angle and an outside face exteriorly of said angle, said corrugated board having a pair of opposed ends, a sheet of solid fibreboard laminated to said outside face of said corrugated board in the form of a right angle, said sheet of solid fibreboard at at least one end having a pair of flaps extending beyond one of said ends of said corrugated board, a basiloid cap including a planar member of a length and width generally corresponding to the width and depth of said article or load and first and second edge flaps integrally hinged to said planar member along four edges thereof, said first and second edge flaps being adapted to wrap around said flaps extending beyond one of said ends of said corrugated board to be secured therewith to secure said basiloid cap to said corner post, a sheet of stretch wrap plastic film enveloping said article or load and said four corner posts.

* * * * *